US007385562B2

(12) United States Patent
Stoyanov et al.

(10) Patent No.: US 7,385,562 B2
(45) **Date of Patent: *Jun. 10, 2008**

(54) MOBILE ANTENNA SYSTEM FOR SATELLITE COMMUNICATIONS

(75) Inventors: Ilian Stoyanov, Sofia (BG); Victor Boyanov, Sofia (BG); Borislav Marinov, Sofia (BG); Zahari Dergachev, Pernik (BG); Aleksandar Toshev, Sofia (BG)

(73) Assignee: RaySat Antenna Systems, L.L.C., Vienna, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/183,007

(22) Filed: Jul. 18, 2005

(65) Prior Publication Data

US 2005/0259021 A1 Nov. 24, 2005

Related U.S. Application Data

(63) Continuation of application No. 10/752,088, filed on Jan. 7, 2004, now Pat. No. 6,999,036.

(51) Int. Cl.
*H01Q 19/18* (2006.01)

(52) U.S. Cl. ..... 343/765; 343/757; 343/853

(58) Field of Classification Search ..... 343/757, 343/711, 765, 766, 753, 754, 853
See application file for complete search history.

(56) References Cited

U.S. PATENT DOCUMENTS

| | | | |
|---|---|---|---|
| 4,801,943 A | 1/1989 | Yabu et al. | |
| 5,089,824 A | 2/1992 | Uematsu et al. | |
| 5,245,348 A | 9/1993 | Nishikawa et al. | |
| 5,309,162 A | 5/1994 | Uematsu et al. | |
| 5,528,250 A * | 6/1996 | Sherwood et al. | 343/711 |
| 5,751,247 A | 5/1998 | Nomoto et al. | |

(Continued)

FOREIGN PATENT DOCUMENTS

| | | |
|---|---|---|
| WO | WO 01/11718 A1 | 2/2001 |

(Continued)

OTHER PUBLICATIONS

Ito, Yashiro and Shigeru Yamazaki, "A Mobile 12Ghz Dsb Television Receiving System", IEEE Transactions on Broadcasting, (Mar. 1989) 35(1):56-61.

(Continued)

*Primary Examiner*—Tan Ho
(74) *Attorney, Agent, or Firm*—Banner & Witcoff, Ltd.

(57) ABSTRACT

Antenna assembly for satellite tracking system that includes a plurality of antenna arrangements, each having one or more ports, and all ports connected through transmission lines in a combining/splitting circuit. The antenna arrangements form a spatial element array able to track a satellite in an elevation plane by mechanically dynamically rotating the antenna arrangements about transverse axes giving rise to generation of respective elevation angles and dynamically changing the respective distances between the axes whilst maintaining a predefined relationship between said distances and the respective elevation angles. The combining/splitting circuit provides phasing and signal delay in order to maintain pre configured radiating parameters. The arrangements can be mounted on a rotating platform to provide azimuth tracking. The system provides dynamic tracking of satellite signals and can be used for satellite communications on moving vehicles.

41 Claims, 8 Drawing Sheets

U.S. PATENT DOCUMENTS

| | | | | |
|---|---|---|---|---|
| 5,886,671 | A | 3/1999 | Riemer et al. | 343/776 |
| 6,043,788 | A * | 3/2000 | Seavey | 343/781 CA |
| 6,124,832 | A * | 9/2000 | Jeon et al. | 347/711 |
| 6,218,999 | B1 * | 4/2001 | Bousquet et al. | 343/765 |
| 6,407,714 | B1 * | 6/2002 | Butler et al. | 343/766 |
| 6,483,472 | B2 * | 11/2002 | Cipolla et al. | 343/765 |
| 6,486,845 | B2 * | 11/2002 | Ogawa et al. | 343/765 |
| 6,496,158 | B1 * | 12/2002 | Ksienski et al. | 343/853 |
| 6,707,432 | B2 * | 3/2004 | Strickland | 343/761 |
| 6,738,024 | B2 * | 5/2004 | Butler et al. | 343/766 |
| 6,839,039 | B2 | 1/2005 | Tanaka et al. | |
| 6,864,846 | B2 * | 3/2005 | King | 343/757 |
| 6,987,489 | B2 * | 1/2006 | Melconian et al. | 343/779 |
| 6,999,036 | B2 * | 2/2006 | Stoyanov et al. | 343/765 |
| 2006/0132372 | A1 * | 6/2006 | Jung et al. | 343/766 |
| 2006/0244669 | A1 * | 11/2006 | Mansour et al. | 343/757 |

FOREIGN PATENT DOCUMENTS

| | | | |
|---|---|---|---|
| WO | WO 02/097919 | A1 | 12/2002 |
| WO | WO 2004/075339 | A2 | 9/2004 |

OTHER PUBLICATIONS

Ito, Yashiro and Shigeru Yamazaki, "A Mobile 12 Ghz Dsb Television Receiving System", IEEE Transactions On Broadcasting, vol. 35(1), pp. 56-61, dated Mar. 1989.

Felstead, E. Barry, "Combining Multiple Sub-Aperatures For Reduced-Profile Shipboard Satcom-Antenna Panels", Institute of Electrical and Electronics Engineers. MICOM 2001. Proceedings, Communications for Networkcentric Operations: Creating The Information Force, IEE Miltrary Communications Conferences, Ny:IEEE, vol. 1 of 2, pp. 665-669, dated Oct. 28-30, 2001, McLean Virginia.

* cited by examiner

MOBILE ANTENNA SYSTEM FOR SATELLITE COMMUNICATIONS

CROSS REFERENCE TO RELATED APPLICATIONS

The present invention is a continuation of U.S. application Ser. No. 10/752,088, filed Jan. 7, 2004 now U.S. Pat. No. 6,999,036. The entire contents of which are hereby incorporated by reference.

FIELD OF THE INVENTION

The present invention relates generally to mobile antenna systems with steerable beams and more particularly to antenna systems utilizing at least partial mechanical movement for use in satellite communications.

BACKGROUND OF THE INVENTION

There is an ever increasing need for communications with satellites, including reception of satellite broadcasts such as television and data and transmission to satellites in vehicles such as trains, cars, SUVs etc. that are fitted with one or more receivers and/or transmitters, not only when the vehicle is stationary (such as during parking) but also when it is moving.

The known antenna systems for use for mobile Direct Broadcast Satellite (DBS) reception can be generally divided into several main types. One type utilizes a reflector or lens antenna with fully mechanical steering. Another type uses phased array antennas comprised of a plurality of radiating elements. The mechanically steerable reflector antenna has a relatively large volume and height, which, when enclosed in the necessary protective radome for mobile use, is too large and undesirable for some mobile applications, especially for ground vehicles. For use with in-motion applications, the antenna housing as a whole should be constrained to a relatively low height profile when mounted on a vehicle.

The array type comprises at least three sub-groups depending on the antenna beam steering means—fully electronic (such as the one disclosed in U.S. Pat. No. 5,886,671 Riemer et al.); fully mechanical; and combined electronic and mechanical steering. The present invention relates to the last two sub-groups.

Phased array antennas are built from a certain number of radiating elements displaced in planar or conformal lattice arrangement with suitable shape and size. They typically take the form of conformal or flat panels that utilize the available space more efficiently than reflector solutions and therefore can provide a lower height profile. In certain cases the mentioned panel arrangements can be divided into two or more smaller panels in order to reduce further the height, thereby rendering such arrangements more suitable for vehicles. Such an antenna for DBS receiving is described in A MOBILE 12 GHZ DBS TELEVISION RECEIVING SYSTEM, authored by Yasuhiro Ito and Shigeru Yamazaki in "IEEE Transactions on Broadcasting," Vol. 35, No. 1, March 1989 (hereinafter "the Ito et al. publication"). As readily shown in FIG. 1 (taken from the Ito et al. publication), the antenna consists of two antenna panels (11 and 12) that represent phased array antennas, pointed to a certain direction. During the satellite tracking they are rotated around their transverse axis (13 and 14, respectively) in order to track the satellite in the elevation plane and continuously all of them together are rotated around the axis that is perpendicular to a common platform (15) in order to track the satellite in the azimuth plane. During this movement, the antenna panels acquire different angular displacements as the angle of elevation is changed. Notwithstanding the fact that the panels 11 and 12 are angularly displaced with respect to each other, their respective axes (13 and 14) are maintained at a fixed distance with respect to each other.

As shown in FIG. 2A, at low elevation (say e1 20), the panels 21 and 22 are seen as a continuous aperture (a1 and a2) as viewed from the observation angle of the satellite 23, thereby maintaining high performance. When increasing the elevation (for example e2>e1 24 in FIG. 2B), the antenna arrangements keep being perpendicular to the observation angle of the satellite (25), but certain space between them becomes visible, thus forming certain gap g1 (26) between the projected apertures a1 and a2. Generally this is a disadvantage because it increases the average level of the sidelobes of the radiation pattern of the antenna system. The increased sidelobes result in decrease in gain and increase of the noise temperature of the antenna system and increased sensitivity to interference, thereby adversely affecting its performance.

There is thus a need in the art to provide a mobile antenna system with low profile and better radiation pattern keeping relatively low cost, suitable for mounting on moving platforms where the size is an issue as is the case in RVs trains, SUVs, bus, boats etc.

SUMMARY OF THE INVENTION

Although the subject invention in connection with various embodiments is generally described in the context of a reception device such as for television reception, the basic principles apply to transmission to satellites and a receive-transmit system could be implemented for two-way communications, e.g. for satellite Internet access while in motion.

The invention will be initially described for satellite television signal reception. The specific design changes for rendering the invention as a transmission device will be readily known to those skilled in the art.

Accordingly, the invention provides an antenna system comprising at least two antenna arrangements, each having at least one port, and all ports connected through transmission lines in a combining/splitting circuit, where said antenna arrangements form a spatial element array able to track a target in an elevation plane by mechanically rotating the antenna arrangements about transverse axes giving rise to generation of respective elevation angles and changing the respective distances between said axes in a predefined relationship at least with the respective elevation angles; said combining/splitting circuit provides phasing and signal delay in order to maintain pre configured radiating parameters.

The invention further provides an antenna system including at least two antenna arrangements mounted on a common rotary platform, using a carriage for each arrangement which provides mechanical bearing for an axis perpendicular to the elevation plane of the antenna arrangement, to thereby provide its elevation movement; wherein the axes of rotation of all antenna arrangements are parallel each to other; two rails joined with the carriages are mounted on the rotary platform at their bottom side, driving means providing linear guided movement of the axes of rotation in direction perpendicular to the axes of rotation of the antenna arrangements.

Still further, the invention provides an antenna system comprising: at least two antenna arrangements each accommodating a transverse axis; a mechanism for rotating the arrangements in order to track a target in the azimuth plane, and rotating each arrangement about its transverse axis in order to track the target in the elevation plane; mechanism for moving the transverse axes one with respect to the other so as to maintain substantially no gaps between antenna apertures as viewed for any elevation angle within selectable elevation angle range.

Still further, the invention provides an antenna system comprising: at least two antenna arrangements each accommodating a transverse axis; a mechanism for rotating the arrangements in order to track a target in the azimuth plane, and rotating each arrangement about its transverse axis in order to track the target in the elevation plane; mechanism for moving the transverse axes one with respect to the other, so as to maintain substantially no gaps between antenna apertures for any location where a target is in the field of view of the antenna system.

Still further, the invention provides an antenna system comprising: at least two antenna arrangements each accommodating a transverse axis; a mechanism for rotating the arrangements in order to track a target in the azimuth plane, and rotating each arrangement about its transverse axis in order to track the target in the elevation plane; mechanism for moving the transverse axes one with respect to the other, whilst maintaining antenna gain and side lobes level within a predefined range for any elevation angle within a predefined range of elevation angles.

Still further, the invention provides an antenna system comprising: at least two antenna arrangements each accommodating a transverse axis; a mechanism for rotating the arrangements in order to track a target in the azimuth plane, and rotating each arrangement about its transverse axis in order to track the target in the elevation plane; mechanism for moving the transverse axes one with respect to the other; the antenna system is not taller than 13 cm.

BRIEF DESCRIPTION OF THE DRAWINGS:

The invention will now be described, by way of example only, with reference to the accompanying drawings, in which.

DETAILED DESCRIPTION OF THE PREFERRED EMBODIMENTS

Figure 3A:
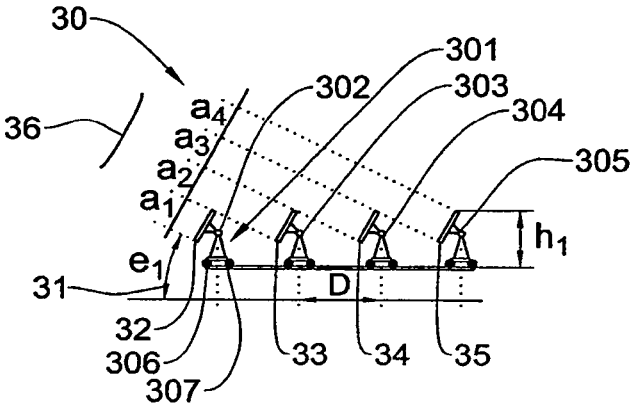
FIGS. 3A-3D illustrate schematically a side view of an antenna unit in different elevation angles, in accordance with an embodiment of the invention.
Figure 3D:
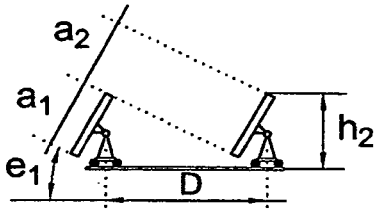
Figure 3B:
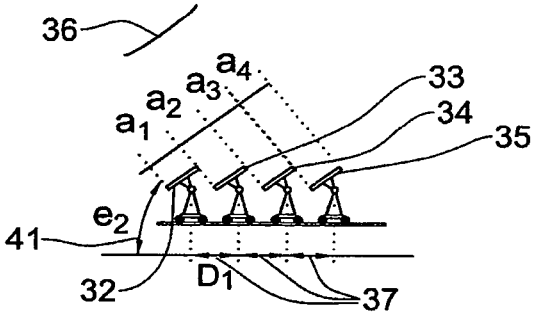
Figure 3C:
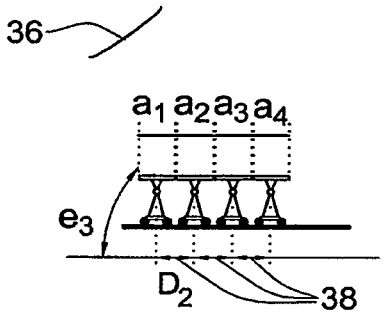
Figure 4A:
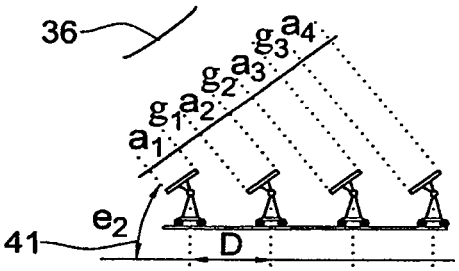
FIG. 4A PRIOR ART
FIGS. 4A-B illustrate schematically a side view of a prior art antenna unit in different elevation angles.

Turning now to FIG. 3A-C, there is shown, schematically a side view of an antenna unit with four antenna arrangements in different elevation angles, in accordance with an embodiment of the invention. Thus, FIG. 3A represents the case of the low elevation angle $e_1$ 31. The antenna unit 30 has four arrangements 32-35 with corresponding projection a1-a4 (where a1 is a corresponding projection of antenna arrangement 31, a2 is corresponding projection to antenna arrangement 32, and so forth). The projections are seen as continuous aperture (a1 to a4) from the observation angle of the satellite 36. Note that the distance between each two respective antenna arrangements is D. As Shown in FIG. 4*a*, when the elevation angle is increased to, say $e_2$ (41) ($e_2 > e_1$) but the distance between the arrangements D remains the same, certain gaps, g1-g3 appear between the apertures a1-a4 (as viewed from the observation angle of the satellite 36). As specified above, these gaps cause an increase in the average level of the sidelobes of the radiation pattern of the antenna system, which eventually leads to degraded antenna performance.

Figure 4B:
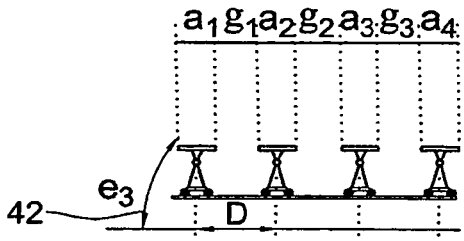
FIG. 4B PRIOR ART

In accordance with an embodiment of the invention (shown in FIG. 3B), the gaps, g1-g3 are closed by changing the distance to D1 (37) (D1<D) between the antenna arrangements 32 to 35, such that the projections a1-a4 of the antenna arrangements 32 to 35 are viewed as a continuous aperture from the observation angle of the satellite 36, thereby maintaining high antenna performance as in the case of lower elevation angle $e_1$ discussed in with reference to FIG. 3A. In a similar manner, further increasing the elevation angle (say, to $e_3$ 42 ($e_3 > e_2$)) would generate gaps g1, g2 and g3 (see FIG. 4B) giving rise to degraded performance. However, further reducing the distance between the antenna arrangements to D2 (D2<D1) would, likewise, result in projections a1-a4 of the antenna arrangements 32 to 35 viewed as continuous aperture from the observation angle of the satellite 36, thereby coping with the degraded antenna performance.

Figure 5A:
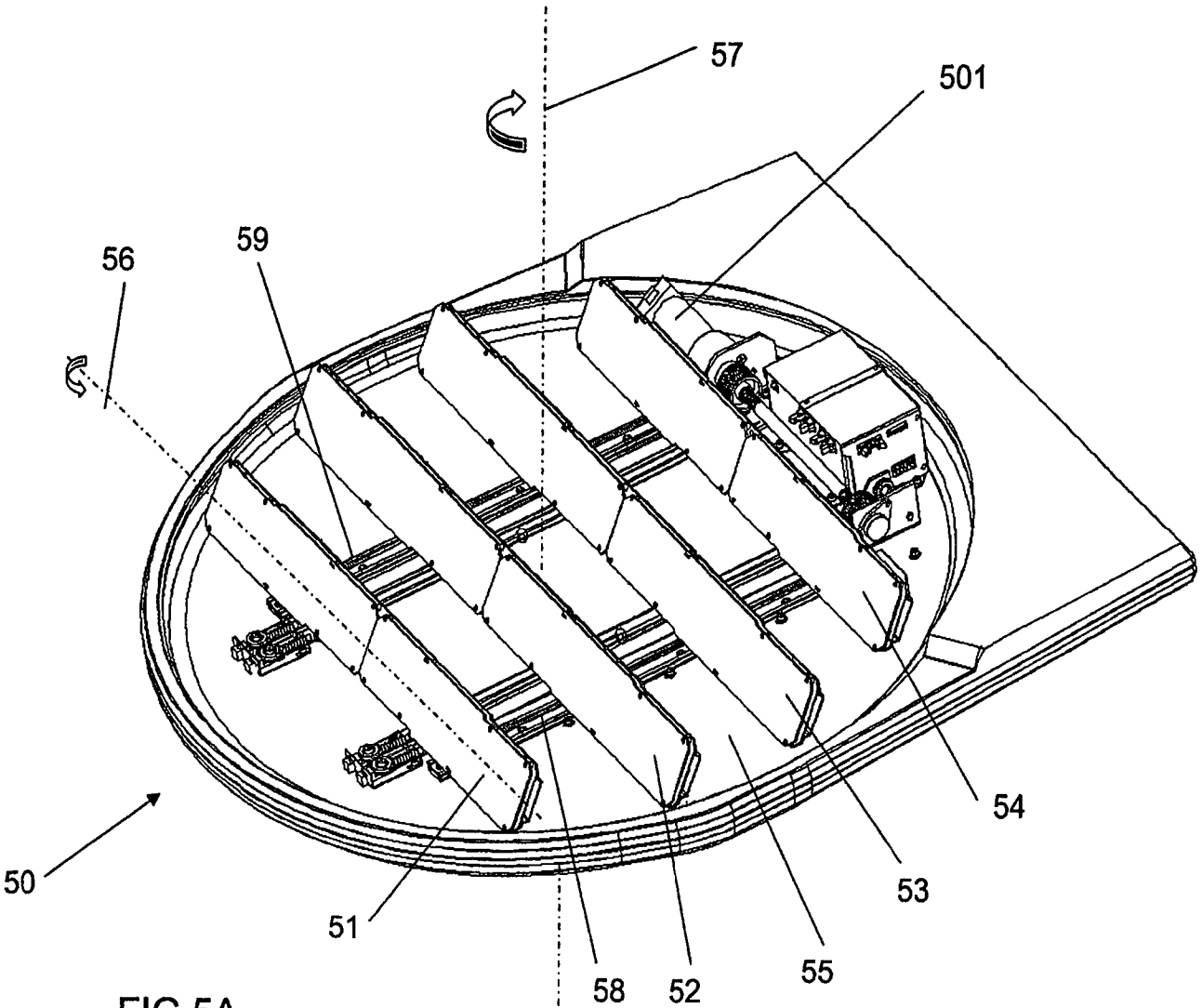
FIG. 5A illustrates a perspective view of an antenna unit, in accordance with an embodiment of the invention.

Turning now to FIG. 5A, there is shown a perspective view of an antenna unit 50, in accordance with an embodiment of the invention. Thus, four antenna arrangements (51 to 54), mounted on a common rotary platform 55 using two carriages for each arrangement (of which one 301 is shown schematically in the side view of FIG. 3A. The carriages provide mechanical bearing for a traversal axis (see, e.g. 302 in FIG. 3A or 56 marked in dashed line in FIG. 5A) perpendicular to the elevation plane of the antenna arrangement. The rotation of the arrangement around the axis provides its elevation movement giving rise to different elevation angles as shown in FIGS. 3A to 3C. The rotation in the azimuth plane is realized by rotating the rotary plane 55 about axis 57 normal thereto, all as known per se. Note that by this embodiment, the steering in the azimuth plane is performed mechanically, by using known per se driving means. The invention is, however, not bound by mechanical movement in the azimuth plane. Reverting now to the elevation plane, the axes of rotation of all antenna arrangements (designated schematically as 302 to 305 in FIG. 3A) are parallel each to other. On the rotary platform 55 are mounted two rails 58 and 59 (see one of them 306 in the side view of FIG. 3A), joined with the carriages (e.g. 302), at their bottom side by (for example) means of wheels (see, e.g. 306 and 307 in FIG. 3A) for facilitating slide motion of the carriages in the rails 58 and 59. This provides linear guided movement in direction perpendicular to the axes of rotation of the antenna arrangements, to thereby modify the distance between the axes of the antenna arrangements (e.g. D, D1 and D2 shown in FIGS. 3A to 3C). An electrical motor 501 with proper gears (not shown) are provided for providing movement of the carriages in the rails. Note that the electrical motor and associated gears are a non-limiting example of driving means.

All antenna arrangements are rotated around their respective transversal axes in a predetermined relationship with the elevation angle and simultaneously with this they are moved back and forth changing the distance between each other, all as described in greater detail below.

Figure 5B:
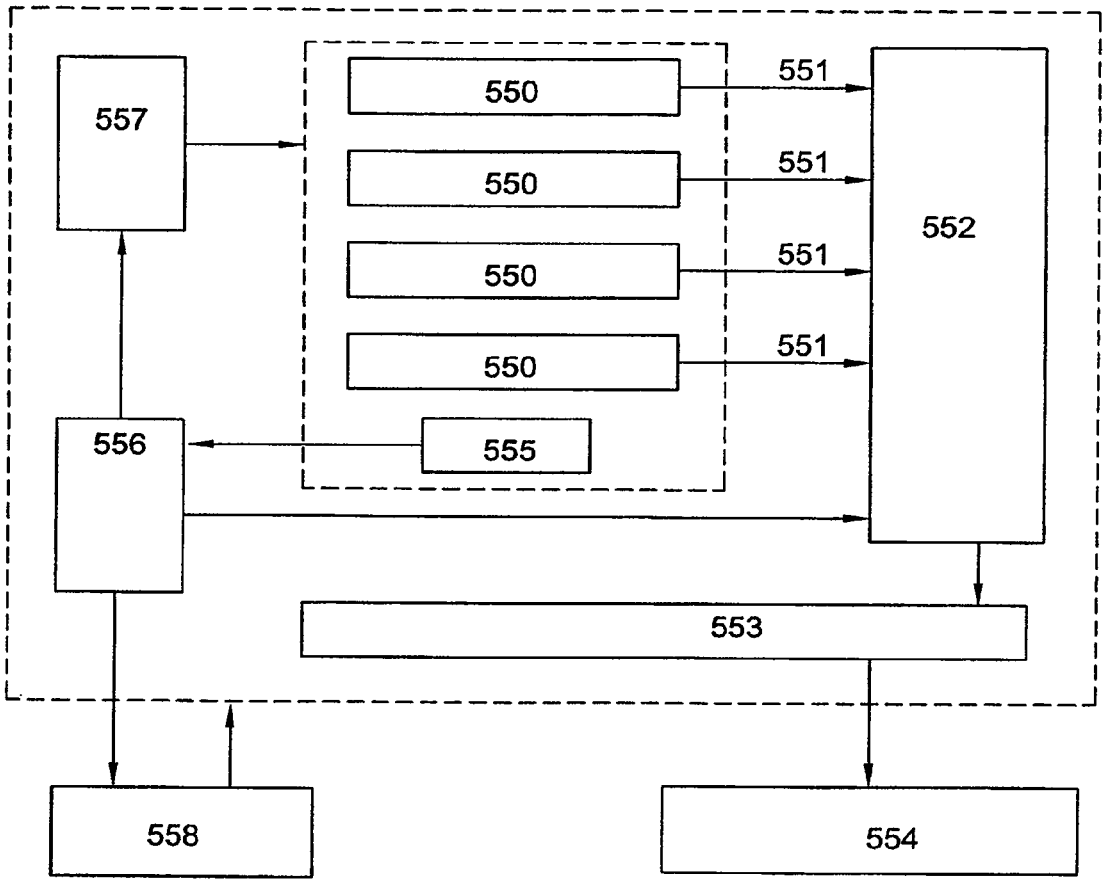
FIG. 5B illustrates a block diagram of signal combining/splitting module, in accordance with an embodiment of the invention.

Note that the description with reference to FIGS. 3 and 5 above provides a specific example of realizing the change in the distance between the antenna arrangements. Those versed in the art will readily appreciate that the invention is by no means bound by this example.

By this embodiment, the movement in the elevation plane is performed by means of mechanically and possibly also electronically steering, all as known per se.

By one embodiment (described with reference to FIG. 5B), all antenna arrangements 550 have signal ports connected trough e.g. coaxial cables 551 to a common RF combining/splitting device 552, which provides combining/splitting of the signals, changing the phase or time delay for each antenna arrangement to combine the signals for each panel in a predetermined relationship with the tracking elevation angle and corresponding instantaneous distance between antenna arrangements and then providing the combined/split signal to the down converter 553 and satellite receiver 554.

The antenna unit tracks the satellite (being an example of a tracked target) using known per se directing and tracking techniques, for instance by using gyroscope or a direction sensor 555, connected to the processor unit 556, which controls elevation and distance movement mechanism 557, azimuth movement mechanism 558 and combining/splitting device 552 to direct the antenna at the satellite and in addition tracking the radio waves received from the satellite. Note that the invention is not bound by the specific manner of operation discussed with reference to FIG. 5B.

Bearing this in mind, there follows a non limiting example concerning change of the distances between the axes (e.g. the specified D, D1 and D2 distances) performed in a predefined relationship with the elevation angle. More specifically by one example the relationship complies with the following equation:

$$D = \frac{1}{\sin(e)} * W,$$

where D represents the distance between said axes of rotation of the arrangements, e is the elevation angle and W is the width of the arrangements' apertures, providing no gaps appearing for any elevation angle (as is the case for example with the specific examples depicted in FIGS. 3A-3C). Note that, if desired, mechanical tilt angle ($\theta_M$) can be used which complies with the following equation: $e=90°-\theta_M$.

Note that the invention is not bound by this specific relationship and accordingly others may apply. Note also that the invention is not bound by the application of the relationship only to the elevation angle, width and distance and, accordingly, additional parameters may be utilized, as will be exemplified in a non limiting manner in the description below.

The invention is, of course, not bound by the use of four antenna arrangements and accordingly other embodiments utilizing two or more antenna arrangements are applicable, all depending upon the particular application.

The description above exemplified a scenario where the distance between each two neighboring antenna arrangements is identical as well as the elevation angle. Thus for instance, in FIG. 3A all the four arrangements 32 to 35 are oriented in the same elevation angle $e_1$ and the distance between each two neighboring arrangements is D. Similarly, in FIG. 3B all the four arrangements 32 to 35 are oriented in the same elevation angle $e_2$ and the distance between each two neighboring arrangements is D1. The same holds true for FIG. 3C, with elevation angle $e_3$ and distance D3. Those versed in the art will readily appreciate that these constraints do not necessarily always apply. For instance, by another embodiment, two or more antenna arrangements may be oriented in a different elevation angle and the distance between the transverse axes of two arrangements may be different than the distance between other two arrangements. By one example, with reference to FIG. 3A, the elevation angle of antenna arrangement 32 may be different from that of 33 (and possibly also from one or more other arrangements) and the distance between the transverse axes of antenna arrangements 32 and 33 may be different than that between antenna arrangements 33 and 34. These examples are, of course, non-limiting.

Note that in accordance with certain embodiments described above and below substantially no gaps are maintained in the antenna aperture for any elevation angle within selectable elevation angle range, as viewed from the observation angle of the satellite.

For instance, for any of the elevation angles $e_1$ to $e_3$ (see FIGS. 3*a* to 3*c*) there are no gaps in the antenna apertures (as viewed from the observation angle of the satellite). This, as explained before, constitutes an advantage insofar as maintaining the side lobes level relatively small, thus maintaining high antenna performance irrespective of the elevation angle.

Note, that by certain embodiments substantially no gaps in antenna aperture are maintained for any location where a target is in the field of view of the antenna system. Thus, by way of non-limiting example, consider an area of interest, say the continental USA or selected areas therein, certain areas of Western Europe, etc. A vehicle (say, for instance, any of train, SUV, RV, car, train, bus, boat, aircraft) that is fitted with an antenna unit of the kind specified travels through different locations in the selected area (say from one town to the other, or in the country side) and the satellite (being an example of a target) is in the field of view of the antenna unit (i.e. the antenna pointing range). Naturally, the antenna unit's orientation (in terms of azimuth and elevation) is changed as the vehicle moves from one place to the other in order to track the satellite. In accordance with the characteristics of certain embodiments of the invention, no gaps in the antenna aperture are encountered for any orientation of the antenna in different locations in the selected area, thereby giving rise to improved antenna performance. For the passengers in the vehicle who use the antenna for various applications (e.g. view satellite television programs received form the satellite through the antenna unit, and/or access internet services through satellite communication, etc.), the latter characteristics of high antenna performance facilitate high fidelity received video, and/or continuous high quality data link for Internet access throughout the entire journey, provided that there exists a field of view between the satellite and the antenna unit.

Providing a controlled modification of the elevation angle in prescribed relationship with the distance between transverse axes of the antenna arrangements give rise to retention of antenna gain and side lobes level within a predefined range for any elevation angle within a pre-defined range of elevation angles. In certain embodiments the antenna gain and side lobes level are maintained substantially the same for any elevation angle within a pre-defined range of elevation angles. Put differently, despite the fact that the elevation angles are changed, the antenna gain does not deteriorate and the side lobes level does not increase.

In certain embodiments, certain optimization is required as will be evident from the description below. Consider the schematic illustration of FIG. 6A, where, as shown, for a given elevation angle, there is a continuous aperture 61 (a1 to a4) as viewed from the observation angle of the satellite (62) all as described in detail above. Notwithstanding the fact that continuous aperture is maintained, note that from a different observation view (63), e.g. normal to rotation platform surface there are rather large gaps (g1, g2 and g3) between the projections of the antenna arrangements a1' to a4' in the direction of observation point 63. As is known per se, these gaps whilst being in a direction (e.g. 63) different than that of the satellite (e.g. 62), they give rise to increased side lobes, thereby reducing the antenna's performance.

Figure 1:
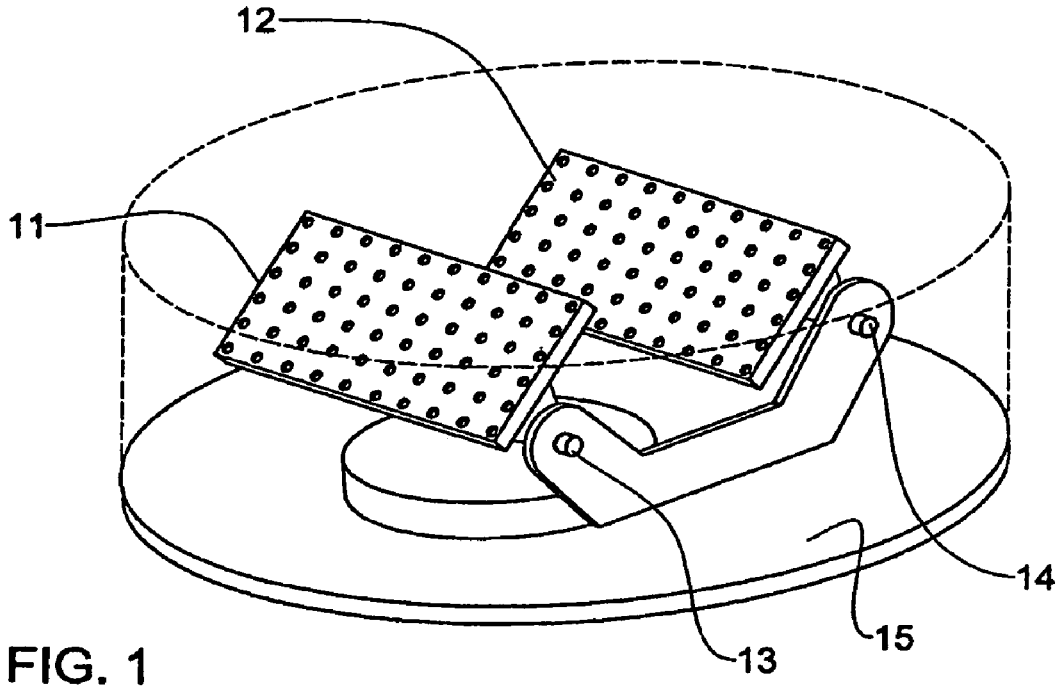
FIG. 1 PRIOR ART
FIG. 1 illustrates an antenna unit, according to the prior art.
Figure 2A:
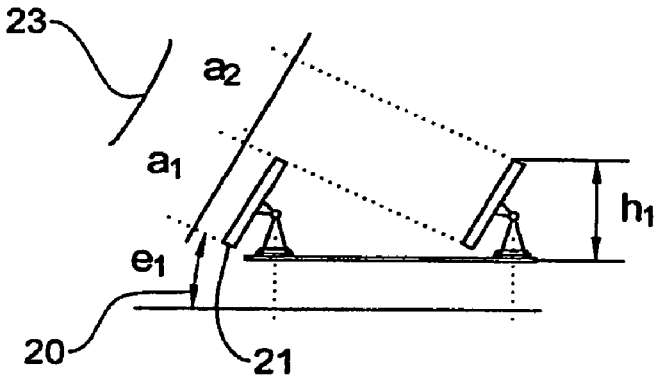
FIG. 2A PRIOR ART
FIGS. 2A-B illustrate schematically a side view of a prior art antenna unit in different elevation angles.
Figure 2B:
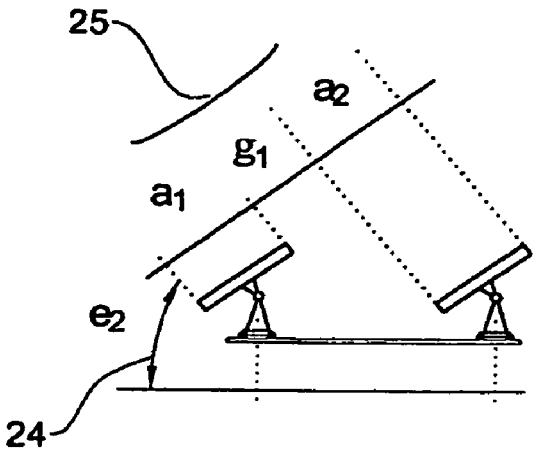
FIG. 2B PRIOR ART

Note, that the antenna performance in accordance with the specified scenario is still considerably better compared to prior art solutions which do not employ change of distance between the antenna arrangements, since in the latter prior art approaches in addition to the specified gaps observed from the other direction (e.g. 63), there are also gaps from the observation angle of the satellite (e.g. g1 in FIG. 2*b*), thereby considerably increasing side lobes and consequently reducing antenna performance.

Figure 6A:
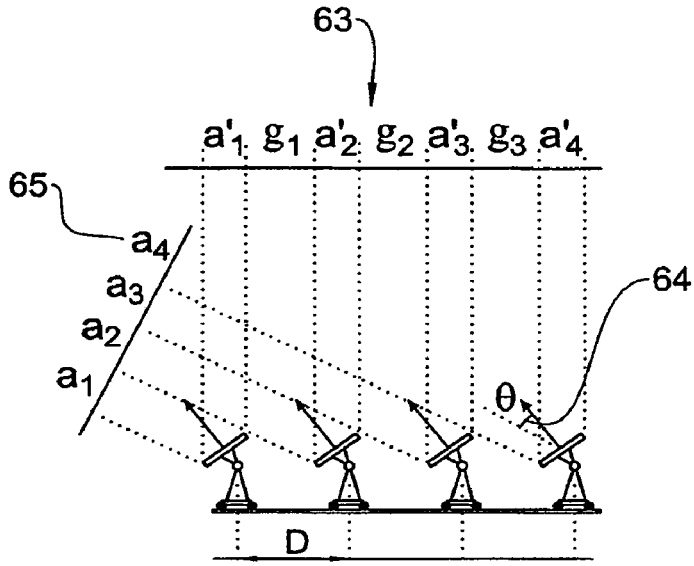
FIGS. 6A-C illustrate schematically a side view of an antenna unit in different elevation angles, in accordance with another embodiment of the invention.

Reverting now to FIG. 6A, in order to cope with the degradation of the antenna performance due to the gaps observed from the other direction, certain optimization approaches may be employed, some of which will be described by way of non limiting examples.

Figure 6B:
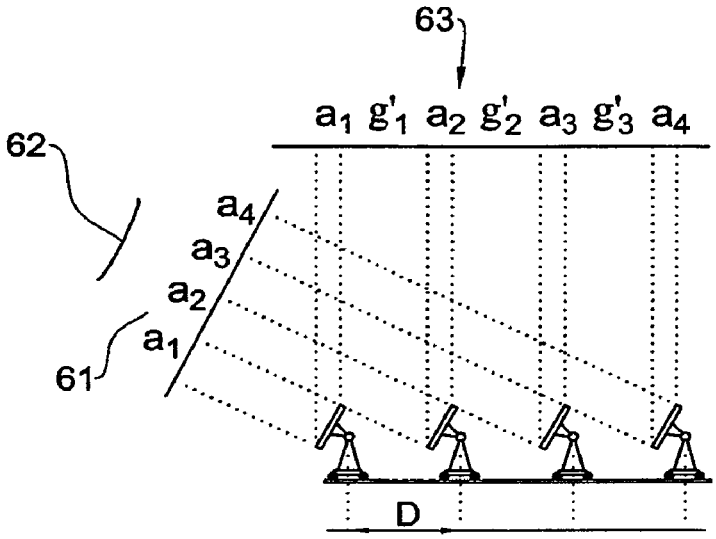

Thus, and as shown in FIG. 6B, a tilt angle θ (64) is applied either statically or through dynamic electronic steering in a certain relationship with the elevation angle e. By the specific example of FIG. 6B, the mechanical elevation angle of the arrangements is increased (compared to that of the embodiment of FIG. 6A), however, an electronic tilt angle θ "compensates" for the increased mechanical elevation angle e, giving rise to substantially the same antenna aperture (65) as (61) in FIG. 6A. Note that the gaps g1', g2' and g3' observed from direction (63) in the configuration of FIG. 6B are considerably smaller than the corresponding gaps g1, g2 and g3 of the configuration of FIG. 6A. The net effect is, therefore, that due to the application of tilt angle the antenna aperture is retained (with no gaps as viewed from the observation angle of the satellite) but the gaps (as viewed from the other direction) are decreased to thereby reduce the side lobes effect and consequently reduce noise signals from the satellite.

When using also tilt, the respective distances between said axes are changes in a predefined relationship at least with the respective elevation angles and the respective tilt angles.

By one embodiment, said respective elevation angles are identical (e) for all antenna arrangements and said respective distances are identical (D) between each neighboring axes, and the respective tilt angles θ are identical for all antenna arrangements. This is by no means binding and, accordingly, by other applications different distances may be employed, different elevation angles and/or different tilt angles, all depending upon the particular application.

By a specific embodiment, the relationship complies with the following equation:

$$D = \frac{\cos(\theta)}{\sin(e)} * W$$

where D represents the distance between said axes, e represents the elevation angle, W represents a width of each antenna arrangement, and θ represents said tilt angle. Note that, if desired, mechanical tilt angle ($\theta_M$) can be used which complies with the following equation: $e=90°-\theta-\theta_M$.

Figure 6C:
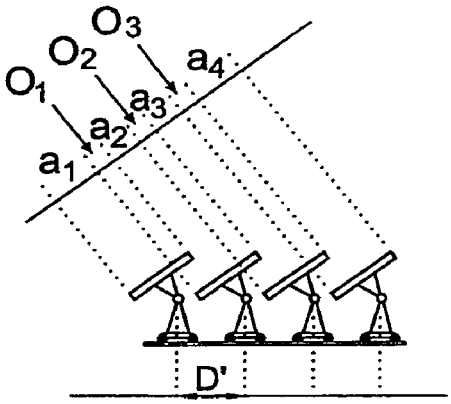

In certain embodiments, yet another form of optimization is performed, in addition or instead to the dynamic/static electronic tilting. Thus, by this example the predetermined relationship between the rotational and linear movements is nonlinear dependence chosen so to minimize the sidelobes for the whole field of view, and performing some overlapping of said projections toward the satellite for lower elevation angles in order to minimize the space occupied from the antenna arrangements. An exemplary overlapping approach is illustrated in FIG. 6C, where the overlapping extent is indicated as O1, O2 and O3. Note also that when overlapping is performed, the gaps viewed from the other direction (63) are reduced or eliminated (not shown in FIG. 3), but this at the cost of reducing the antenna aperture (due to the overlapping), thereby reducing the antenna gain.

Those versed in the art will readily appreciate that the optimization approaches discussed herein are by no means binding. Thus, whether to apply optimization and whether to employ either or both of tilt and overlapping and to what extent is determined depending upon the particular application and the specification for the sought gain, allowed sidelobes level and possibly other parameters. Other optimization techniques may be employed, in addition or in instead of the above, all depending upon the particular application.

Figure 7A:
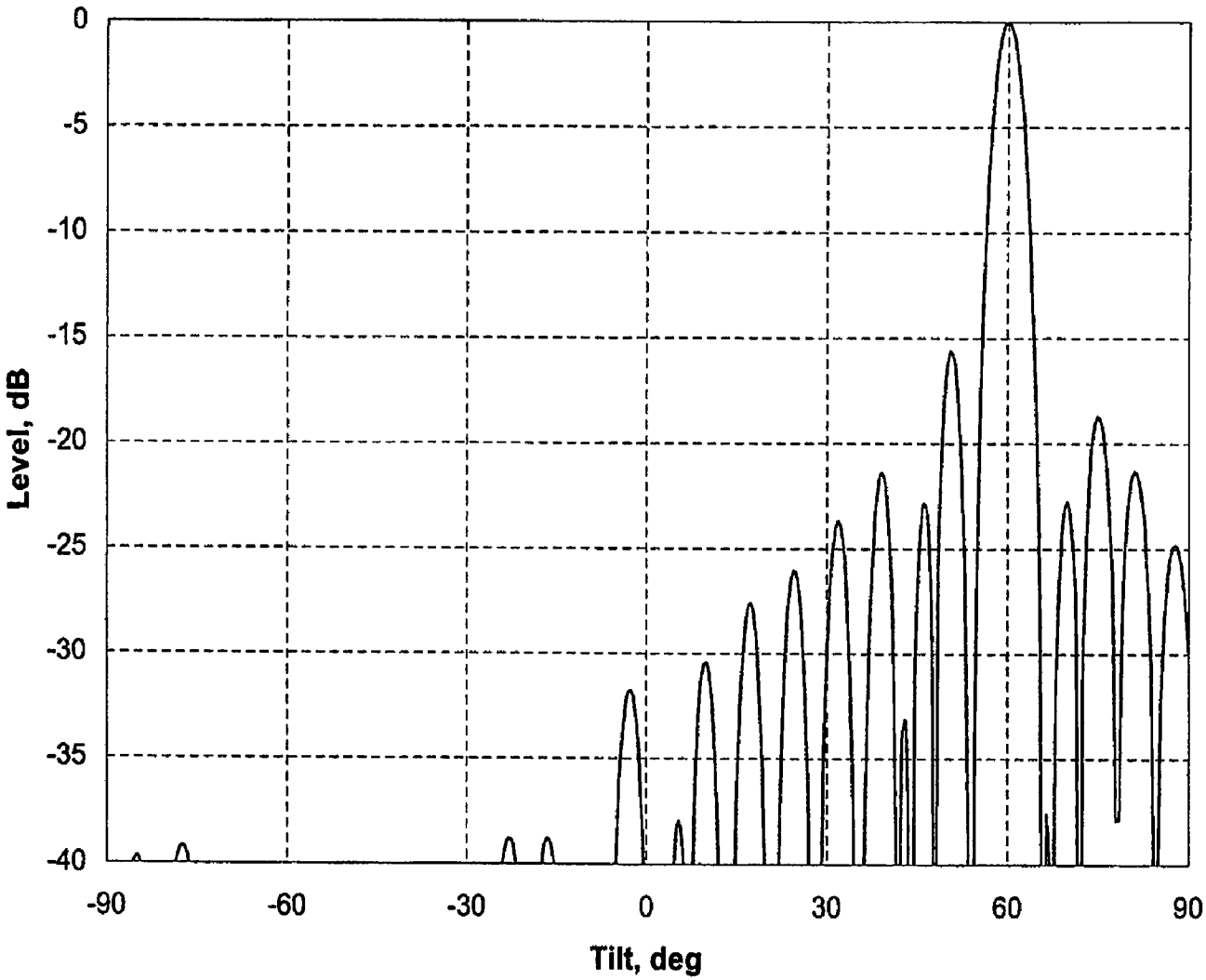
FIGS. 7A-C illustrate three plots of antenna patterns in three distinct operational scenarios.
Figure 7B:
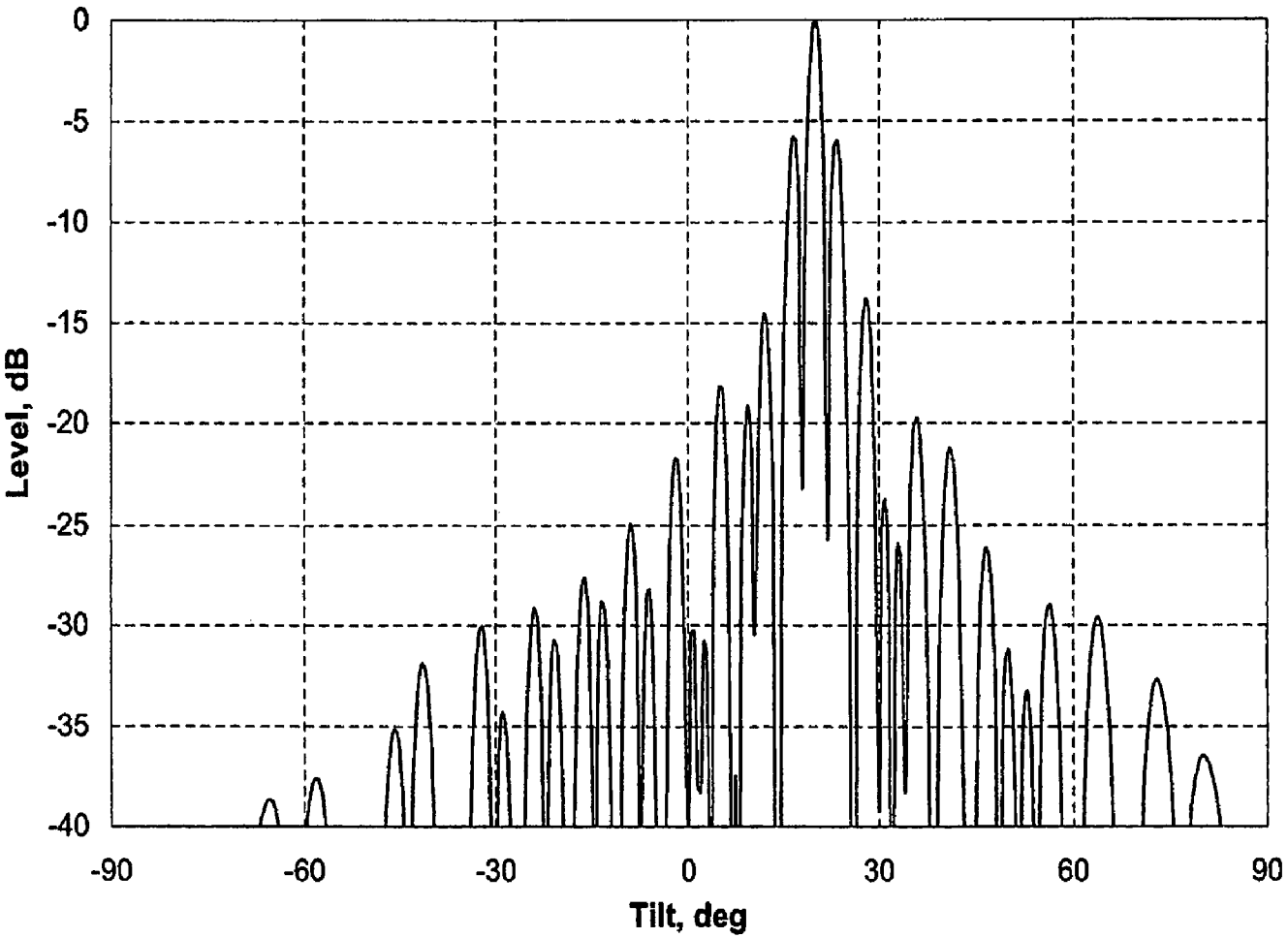
Figure 7C:
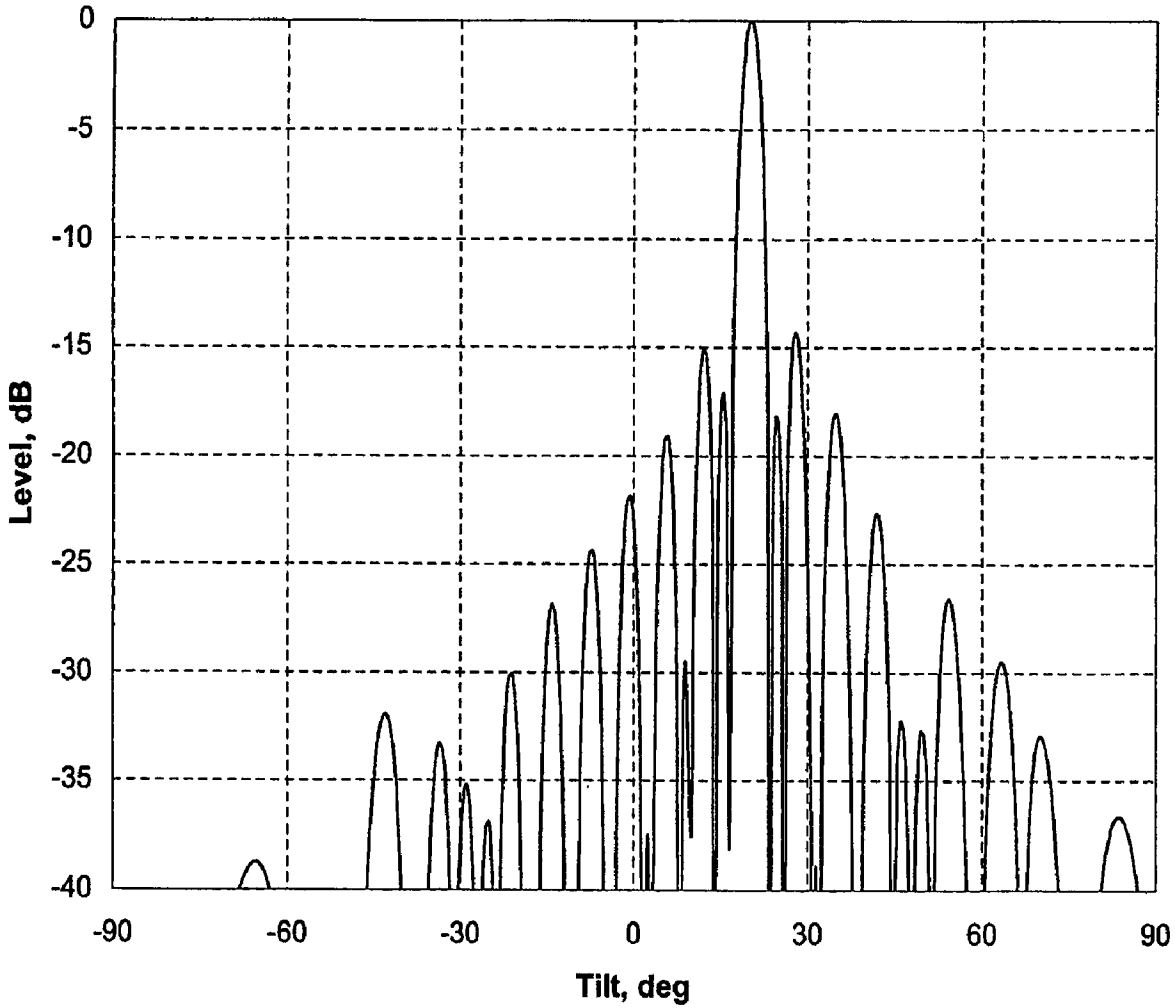

Turning now to FIGS. 7A-C illustrate three plots of antenna patterns in three distinct (non-limiting) operational scenarios. Note, incidentally, that the abscissa in the specified plots indicates mechanical tilt angle $\theta_M$ which has a prescribed relationship with the elevation angle e discussed above.

FIG. 7A depicts the antenna pattern in the following operational scenario

Elevation=20 deg
Freq=12.5 GHz
D=383 mm
W=120 mm

Thus, for 4-panel antenna with the distances between panels optimized (using static tilt angle θ of 10° for 20° elevation angle). No gaps in the antenna aperture are viewed from the direction of the satellite. The antenna gain is achieved at mechanical tilt 60° (i.e. 90° minus the elevation angle 20° minus the static tilt angle 10°). The sidelobes are at low level of −15 dB and less, thereby exhibiting good antenna performance. Moving on to FIG. 7B, the antenna's elevation angle is increased to 60° maintaining however the same distance between the antenna arrangement's traversal axes (383 mm) as in the prior art. This gives rise to introduction of gaps (as shown for example in FIG. 2B) and, indeed, the antenna's performance is evidently degraded, due to the introduction of very high sidelobes approaching −5 dB around mechanical tilt angle 20°.

FIG. 7C illustrates how the antenna's performance are considerably improved for the same mechanical tilt angle of 60° as in FIG. 7B, using the same tilt angle of 10°, however now employing the distance modification technique according to certain embodiment of the invention arriving to distance D=210 mm (instead of 383 mm), thereby eliminating the gaps when viewed from the observation angle of the satellite. As shown, the sidelobes are again reduced to −15 dB or less at the vicinity of the antenna gain around mechanical tilt angle 20°.

Those versed in the art will readily appreciate that the examples depicted in FIGS. 7A-7C are for illustrative purposes only and are by no means binding.

In one embodiment the antenna arrangements have, each, more than one signal port (for, say, signal outputs) thereby providing more than one polarization, for example, linear vertical or linear horizontal polarization (which may be combined to form dual/single linear polarizations with any polarization tilt angles), and/or left hand circular or right hand circular polarization.

In one embodiment, the antenna arrangements (e.g. 51 to 54 of FIG. 5A) are realized as planar phased array antennas (being an example of planar element array). By another embodiment, the arrangements are realized as conformal phased arrays (being an example of conformal element array)—not shown. By still another embodiment, the arrangements are realized as e.g. reflector, lens or horn antennas. Other variants are applicable, all depending upon the particular application.

In one embodiment each of said antenna arrangements consists of more than one planar phased array antenna modules, acting together as one antenna.

In accordance with certain embodiment of the invention, a reduced height of the antenna unit is achieved, thereby permitting a relatively low-height for the protective radome. For instance, for a DBS reception system operating at Ku-band (12 GHz) this could permit a height reduction to less than 13 cm, or even less than 10 cm (or even preferably less than 8 cm). By one embodiment, the antenna has a diameter of 80 cm. (see 50 in FIG. 5A). The reduced height of the antenna unit is achieved due the use of more antenna arrangements and the distance change between the arrangements, all as described above. The fact that more arrangements of smaller size are used and give rise to reduced height as is clearly illustrated in FIGS. 3A and 3D. Thus, in the latter, fewer arrangements are used, however in order to obtain the same antenna aperture as that of the configuration of FIG. 3A (for the same elevation angle $e_1$) larger arrangements are utilized, giving rise to height $h_2$ which is considerably lager than $h_1$ achieved in the configuration that employs more arrangements, each of smaller width (see FIG. 3A).

Note that the use of antenna arrangements of smaller size (in accordance with the invention) whilst not adversely affecting the antenna's performance is brought about due to the use of variable distances between the antenna arrangements. Whenever necessary, additional optimizing techniques are used, all as described in detail above. The use of antenna unit with reduced height, is an esthetic and practical advantage for a vehicle, such as train, SUV, RV, and car.

In certain embodiments the antenna arrangements provide transmit, receive or both modes. For example, array panels implemented for transmission at a suitable frequency, e.g. 14 GHz or at Ka-band (around 30 GHz) may be combined with those for reception, either on the same array panels, on different panels mounted to the same platform, or on a completely separate rotating platform. The tracking information for the transmit beam(s) could, in one example, be derived from the information received by the reception beam(s). The principles embodied herein would apply. If multiple transmit panels, separate from the receive panels, are used, the transmit panel spacings would be adjusted separately from those of the receive panels. If transmit and receive functions are combined on the same panels, the spacing criteria for the radiating elements and the inter-panel spacings can be derived from straightforward application of array antenna design principles and the panel spacing criteria described herein.

The present invention has been described with a certain degree of particularity, but those versed in the art will readily appreciate that various alterations and modifications may be carried out without departing from the scope of the following claims:

1. An antenna assembly for satellite tracking system comprising at least two antenna arrangements forming a spatial element array capable of dynamic tracking a target in an elevation plane by mechanically dynamically rotating the antenna arrangements about transverse axes giving rise to generation of respective elevation angles, and dynamically changing the respective distances between said axes whilst maintaining a predefined relationship between said distances and respective elevation angles; said antenna arrangement each having at least one port, and all ports connected to at least one combining/splitting circuit providing phasing and signal delay in order to maintain pre configured radiating parameters.

2. The antenna assembly of claim 1, wherein projections of said antenna arrangements on a plane perpendicular to the elevation direction are substantially touching or overlapping.

3. The antenna assembly of claim 1, wherein projections of said antenna arrangements on a plane perpendicular to the elevation direction have at most small gaps while maintaining pre configured sidelobe parameters.

4. The antenna assembly of claim 1, wherein said antenna arrangements are planar element arrays.

5. The antenna assembly of claim 4, wherein said planar element arrays being planar phased arrays.

6. The antenna assembly of claim 1, wherein said antenna arrangements are conformal element arrays.

7. The antenna assembly of claim 6, wherein said conformal element arrays being conformal phased arrays.

8. The antenna assembly of claim 1, wherein said antenna arrangements being one from a group that includes reflector antenna, lens antenna, slot antenna, line source antenna, and horn antenna.

9. The antenna assembly of claim 1, wherein, during said dynamic tracking, said respective elevation angles are substantially identical (e) for all antenna arrangements, and said respective distances are substantially identical (D) between each neighboring axes.

10. The antenna assembly of claim 1, wherein said relationship substantially complies with the following equation: 3D=1 sin(e)*W, where D represents the distance between said axes, e represents said elevation angle, and W represents a width of each antenna arrangement.

11. The antenna assembly of claim 1, wherein the antenna arrangements are able to track a target in an elevation plane by further providing respective tilt angles .theta. from a normal to an aperture plane of a corresponding antenna arrangement; the respective distances between said axes are changed in a predefined relationship at least with the respective elevation angles and the respective tilt angles.

12. The antenna assembly of claim 11, wherein said respective elevation angles are identical (e) for all antenna arrangements and said respective distances are identical (D) between each neighboring axes, and the respective tilt angles .theta. are identical for all antenna arrangements.

13. The antenna assembly of any one of claims 11 to 12, wherein said relationship substantially complies with the following equation: 4D=cos()sin(e) * W where D represents the distance between said axes, e represents the elevation angle, W represents a width of each antenna arrangement, and .theta. represents said tilt angle.

14. The antenna assembly of claim 13, wherein said tilt angle is static.

15. The antenna assembly of claim 13, wherein said tilt angle can be steered.

16. The antenna assembly of claim 1, wherein each antenna arrangement has more than one signal port providing more than one polarization.

17. The antenna assembly of claim 16, wherein said more than one polarization includes linear vertical or linear horizontal polarization.

18. The antenna assembly of claim 17, wherein said linear vertical or linear horizontal polarization are combined to form dual/single linear polarizations with any polarization tilt angles.

19. The antenna assembly of claim 16, wherein said more than one polarization includes left hand circular or right hand circular polarization.

20. The antenna assembly of claim 1, wherein said arrangements provide either or both of transmit and receive mode.

21. The antenna assembly of claim 1, wherein each one of said antenna arrangements consists of more than one planar element array antenna module.

22. The antenna assembly of claim 21, wherein said planar element array antenna modules being planar phase array antenna modules.

23. The antenna assembly of claim 1, wherein the relationship between the respective distances and the respective elevation angles is non-linear chosen to maximize gain and minimize side lobes for a whole field of view, and performing selected overlapping of projections towards the target for lower elevation angles.

24. The antenna assembly of claim 1, wherein the relationship between the respective distances and the respective elevation angles is configured to vary dynamically to optimize gain and side lobes for a whole field of view.

25. The antenna assembly of claim 1, wherein the relationship between the respective distances and the respective elevation angles is fixed to optimize projections towards the target for certain elevation angles.

26. The antenna assembly of claim 1, wherein said target being a selected satellite, and wherein said antenna is configured to be fitted on mobile vehicle, for communicating with satellite signals during stationary and moving states of said vehicle.

27. The antenna assembly of claim 26, wherein said vehicle being any of: train, bus, SUV, RV, boat, car, truck, aircraft, farm vehicle.

28. The antenna assembly of claims 26 or 27, wherein said assembly is configured to be fitted on mobile vehicle, for receiving Satellite signal during stationary and moving states of said vehicle.

29. The antenna assembly of claim 1, being of up to 13 cm height when fitted on a vehicle.

30. The antenna assembly of claim 1, being of up to 10 cm height when fitted on a vehicle.

31. An antenna assembly for satellite tracking system including at least two antenna arrangements mounted on a common rotary platform, using a carriage for each arrangement which provides mechanical bearing for an axis perpendicular to the elevation plane of the antenna arrangement, to thereby provide its dynamic elevation movement; wherein the axes of rotation of all antenna arrangements are parallel each to other; two rails joined with the carriages are mounted on the rotary platform at their bottom side, driving means providing linear guided movement of the axes of rotation in direction perpendicular to the axes of rotation of the antenna arrangements in a predefined relationship at least with the respective elevation movement.

32. The antenna assembly of claim 31, being of up to 13 cm height when fitted on a vehicle.

33. The antenna assembly of claim 31, being of up to 10 cm height when fitted on a vehicle.

34. An antenna assembly for satellite tracking system comprising: at least two antenna arrangements each accommodating a transverse axis; a mechanism for rotating the arrangements in order to track a target in an azimuth plane, and rotating each arrangement about its transverse axis in order to dynamically track the target in an elevation plane, each antenna arrangement defining a projected aperture, the system further includes at least one of the following: (a) mechanism for dynamically changing distance between the transverse axes so as to maintain substantially no gaps between antenna apertures as viewed for any elevation angle within selectable elevation angle range; (b) mechanism for dynamically changing distance between the transverse axes, so as to maintain substantially no gaps between antenna apertures for any location where a target is in the field of view of the antenna system; (c) mechanism for dynamically changing distance between the transverse axes, whilst maintaining antenna gain and side lobes level within a predefined range for any elevation angle within a pre-defined range of elevation angles.

35. The antenna assembly of claim 34, wherein said mechanism for moving the transverse axes one with respect to the other, whilst maintaining antenna gain and side lobes level within a predefined range for any elevation angle within a pre-defined range of elevation angles is configured to move the transverse axes one with respect to the other, whilst maintaining antenna gain and side lobes level substantially the same for any elevation angle within a predefined range of elevation angles.

36. The antenna assembly of claim 35, further providing mechanism for providing tilt angle for each arrangement, for reducing the side lobe level.

37. The antenna assembly of claim 36, wherein said tilt angle is static.

38. The antenna assembly of claim 36, wherein said tilt angle can be steered.

39. The antenna assembly of claim 34, being of up to 13 cm height when fitted on a vehicle.

40. The antenna assembly of claim 34, being of up to 10 cm height when fitted on a vehicle.

41. An antenna assembly for satellite tracking system comprising: at least two antenna arrangements each accommodating a transverse axis; a mechanism for rotating the arrangements in order to track a target in an azimuth plane, and rotating each arrangement about its transverse axis in order to track the target in an elevation plane; mechanism for dynamically changing distance between the transverse axes; the antenna system is not taller than 13 cm.

* * * * *